US007227307B2

(12) United States Patent
Yoo et al.

(10) Patent No.: US 7,227,307 B2
(45) Date of Patent: Jun. 5, 2007

(54) PLASMA DISPLAY PANEL

(75) Inventors: Hun-Suk Yoo, Cheonan-si (KR); Kyoung-Doo Kang, Seoul (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 178 days.

(21) Appl. No.: 11/074,839

(22) Filed: Mar. 9, 2005

(65) Prior Publication Data

US 2005/0212425 A1 Sep. 29, 2005

(30) Foreign Application Priority Data

Mar. 26, 2004 (KR) ..... 10-2004-0020767

(51) Int. Cl.
*H01J 17/49* (2006.01)

(52) U.S. Cl. ..... 313/587; 313/582

(58) Field of Classification Search ..... 313/581–587, 313/153

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Ashok Patel
(74) *Attorney, Agent, or Firm*—Robert E. Bushnell, Esq.

(57) ABSTRACT

A plasma display panel that improves luminance efficiency by increasing a plasma density by forming a magnetic field within a discharge space includes: a front substrate, a rear substrate, barrier ribs, upper sidewalls, address electrodes, discharge electrodes, a phosphor layer, and magnets. The front and rear substrates are arranged at a predetermined distance apart to face each other. The barrier ribs are arranged between the front and rear substrates to partition a space formed between the front and rear substrates into a plurality of discharge spaces. The upper sidewalls are arranged between the barrier ribs and the front substrate to define the discharge spaces in cooperation with the barrier ribs. The address electrodes extend in one direction over the rear substrate. The discharge electrodes are arranged within the upper sidewalls, the discharge electrodes arranged in parallel at a predetermined distance apart in a direction from the front substrate to the rear substrate to surround the discharge spaces and to extend across the address electrodes. The phosphor layer is arranged on at least one surface of each of the discharge spaces. The magnets are arranged in the upper sidewalls at a predetermined distance apart in a direction from the discharge electrodes to the discharge spaces.

19 Claims, 8 Drawing Sheets

U.S. PATENT DOCUMENTS 5,952,782 A 9/1999 Nanto
5,959,403 A * 9/1999 Lee ..... 313/590
5,962,975 A * 10/1999 Lepselter ..... 313/586
RE37,444 E 11/2001 Kanazawa
6,630,916 B1 10/2003 Shinoda
6,707,436 B2 3/2004 Setoguchi et al.
6,741,032 B2 * 5/2004 Yoo ..... 313/587

FOREIGN PATENT DOCUMENTS

JP 2845183 10/1998
JP 2917279 4/1999
JP 2001-043804 2/2001
JP 2001-325888 11/2001

* cited by examiner

PLASMA DISPLAY PANEL

CLAIM OF PRIORIYR

This application makes reference to, incorporates the same herein, and claims all benefits accruing under 35 U.S.C. section 119 from an application for PLASMA DISPLAY PANEL earlier filed in the Korean Intellectual Property Office on 26 Mar. 2004 and there duly assigned Serial No. 2003-20767.

BACKGROUND OF THE INVENTION

1. Field of the Invention

The present invention relates to a plasma display panel, and more particularly, to a plasma display panel that improves the luminance efficiency by increasing a plasma density by forming a magnetic field within a discharge space.

2. Description of the Related Art

A Plasma Display Panel (PDP) display, which is a flat panel display, has excellent characteristics, namely, displays a high-quality image, is extremely thin and light, and provides a wide viewing angle, while having a large screen. In addition, a PDP display can be more simply manufactured than other flat panel displays and can be easily enlarged, such that the PDP display is spotlighted as a next-generation flat panel display.

In a 3-electrode surface discharge PDP, address electrode lines $A_{R1}$, $A_{G1}$, . . . , $A_{Gm}$, and $A_{Bm}$, front and rear dielectric layers, Y electrode lines $Y_1$, . . . , and $Y_n$, X electrode lines $X_1$, . . , and $X_n$, phosphors, barrier ribs, and a MgO protective layer are disposed between front and rear glass substrates of the 3-electrode surface discharge PDP.

The address electrode lines $A_{R1}$, $A_{G1}$, . . . , $A_{Gm}$, and $A_{Bm}$ are arranged in a predetermined pattern over the rear glass substrate. The rear dielectric layer is entirely coated over the address electrode lines $A_{R1}$, $A_{G1}$, . . . , $A_{Gm}$, and $A_{Bm}$. The barrier ribs are formed on the front surface of the rear dielectric layer to be parallel to the address electrode lines $A_{R1}$, $A_{G1}$, . . . , $A_{Gm}$, and $A_{Bm}$. The barrier ribs define discharge areas of each discharge cell and prevent optical crosstalk between adjacent discharge cells. The phosphors 16 are coated between barrier ribs.

The X electrode lines $X_1$, . . . , and $X_n$ and the Y electrode lines $Y_1$, . . , and $Y_n$ are patterned on a rear surface of the front glass substrate so as to be orthogonal to the address electrode lines $A_{R1}$, $A_{G1}$, . . . , $A_{Gm}$, and $A_{Bm}$. The respective intersections define corresponding discharge cells. The X electrode lines $X_1$, . . . , and $X_n$ and the Y electrode lines $Y_1$, . . . , and $Y_n$ are each comprised of a transparent electrode line of a conductive material, such as, Indium Tin Oxide (ITO), and a metal electrode line for increasing conductivity. For example, the X electrode line $X_n$ is comprised of a transparent electrode line $X_{na}$ and a metal electrode line $X_{nb}$, and the Y electrode line $Y_n$ is comprised of a transparent electrode line $Y_{na}$ and a metal electrode line $Y_{nb}$. The front dielectric layer is entirely coated over the X electrode lines $X_1$, . . . , and $X_n$ and the Y electrode lines $Y_1$, . . . , and $Y_n$. The MgO protective layer for protecting the panel against strong electric fields is coated over the entire rear surface of the front dielectric layer. Discharge spaces are sealed with a gas therein for forming a plasma.

In the 3-electrode surface discharge PDP, not only the X electrode lines $X_1$, . . . , and $X_n$, the Y electrode lines $Y_1$, . . . , and $Y_n$, but also the dielectric layer and the protective layer formed on the X and Y electrode lines exist on the front glass substrate. During discharge, visible rays emitted from the phosphors in the discharge spaces pass through the front substrate. However, the 3-electrode surface discharge PDP has a significant problem in that only about 60% of the visible rays are transmitted by the front substrate because of various components formed on the front substrate.

Also, in the 3-electrode surface discharge PDP, electrodes provoking the discharge are formed over the discharge spaces, namely, on the inner surface of the front substrate 10 through which the visible rays pass, such that the discharge is generated on the inner surface thereof and spreads. Hence, the 3-electrode surface discharge PDP has a low luminance efficiency.

Furthermore, when the 3-electrode surface discharge PDP is used for a long period of time, charged particles of a discharge gas cause ion sputtering on the phosphors due to an electric field, thereby generating a permanent residual image.

SUMMARY OF THE INVENTION

The present invention provides a plasma display panel having a structure different from a structure of a conventional plasma display panel.

The present invention also provides a plasma display panel that improves the luminance efficiency by increasing a plasma density by forming a magnetic field within a discharge space.

According to one aspect of the present invention, a plasma display panel is provided including: a front substrate and a rear substrate arranged at a predetermined distance apart to face each other; barrier ribs arranged between the front and rear substrates to partition a space formed between the front and rear substrates into a plurality of discharge spaces; upper sidewalls arranged between the barrier ribs and the front substrate to define the discharge spaces in cooperation with the barrier ribs; address electrodes extending in one direction over the rear substrate; discharge electrodes arranged within the upper sidewalls, the discharge electrodes arranged in parallel at a predetermined distance apart in a direction from the front substrate to the rear substrate so as to surround the discharge spaces and so as to extend across the address electrodes; a phosphor layer arranged on at least one surface of each of the discharge spaces; and magnets arranged in the upper sidewalls at a predetermined distance apart in a direction from the discharge electrodes to the discharge spaces.

The magnets preferably comprise permanent magnets.

The magnets are preferably arranged to surround the discharge spaces.

The magnets are preferably arranged perpendicular to a direction from the front substrate to the rear substrate.

Each magnet is preferably arranged with one of its N and S poles facing the front substrate and the other of its N and S poles facing the rear substrate.

The discharge electrodes preferably comprise: Y electrodes adapted to select a discharge space to emit light from the discharge spaces by provoking an address discharge between the Y electrodes and the address electrodes; and X electrodes provoking a sustain discharge between the Y electrodes and the X electrodes.

The discharge electrodes are preferably arranged perpendicular to the front substrate.

The upper sidewalls preferably comprise a dielectric.

The upper sidewalls are preferably covered with an MgO layer.

The plasma display panel preferably further comprises a dielectric layer adapted to cover the address electrodes.

According to another aspect of the present invention, a plasma display panel is provided including: a front substrate and a rear substrate arranged at a predetermined distance apart to face each other; barrier ribs arranged between the front and rear substrates to partition a space formed between the front and rear substrates into a plurality of discharge spaces; address electrodes extending in one direction over the rear substrate; discharge electrodes arranged within the upper sidewalls, the discharge electrodes arranged in parallel at a predetermined distance apart in a direction from the front substrate to the rear substrate so as to surround the discharge spaces and so as to extend across the address electrodes; a first dielectric layer adapted to cover the discharge electrodes; a phosphor layer arranged on at least one surface of each of the discharge spaces; and magnets arranged in the upper sidewalls at a predetermined distance apart in a direction from the discharge electrodes to the discharge spaces.

The magnets preferably comprise permanent magnets.

The magnets are preferably arranged to surround the discharge spaces.

The magnets are preferably arranged perpendicular to a direction from the front substrate to the rear substrate.

Each magnet is preferably arranged with one of its N and S poles facing the front substrate and the other of its N and S poles facing the rear substrate.

The discharge electrodes preferably comprise: Y electrodes adapted to select a discharge space to emit light from the discharge spaces by provoking an address discharge between the Y electrodes and the address electrodes; and X electrodes provoking a sustain discharge between the Y electrodes and the X electrodes.

The discharge electrodes are preferably arranged perpendicular to the front substrate.

The first dielectric layer is preferably covered with an MgO layer.

The plasma display panel preferably further comprises a second dielectric layer adapted to cover the address electrodes.

In the plasma display panels, the plasma density is increased due to an influence of a magnetic field formed by the magnets, the density of excited particles of a discharge gas is accordingly increased, the amount of ultraviolet light emitted is increased, and thus the luminance efficiency is improved.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein.

DETAILED DESCRIPTION OF THE INVENTION

Figure 1:
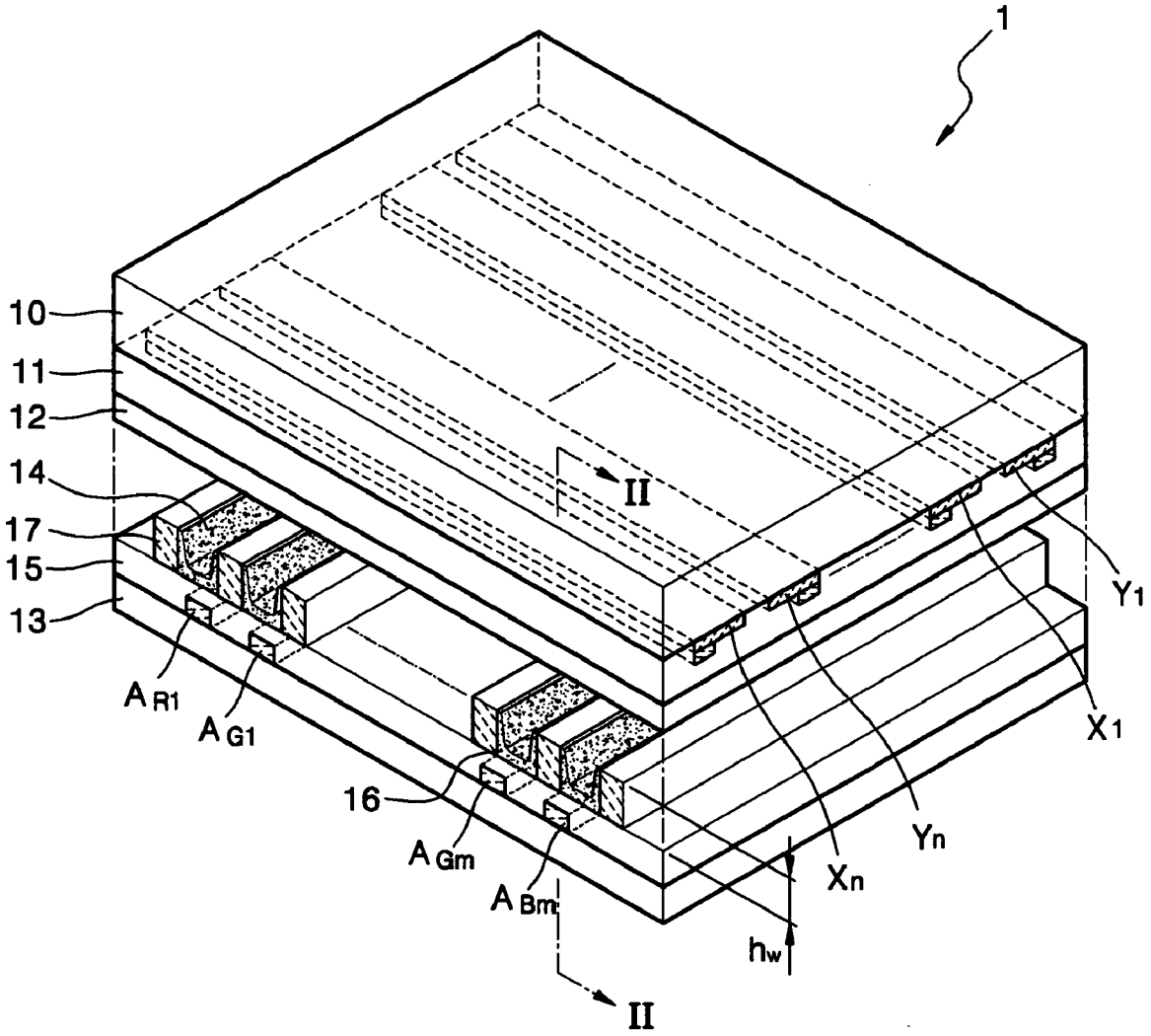
FIG. 1 is an internal perspective view of a 3-electrode surface discharge plasma display panel (PDP)
Figure 2:
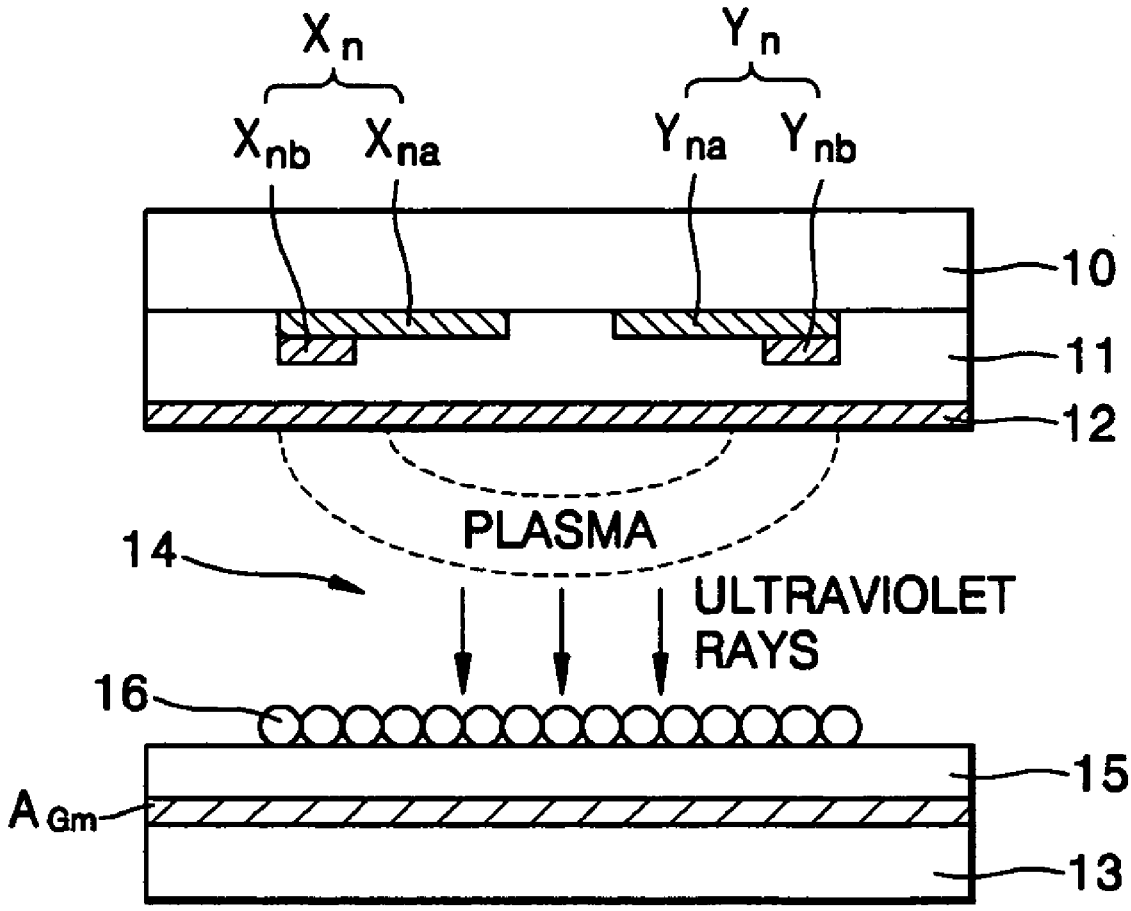
FIG. 2 is a cross-section of a unit display cell of the PDP of FIG. 1.

FIG. 1 is an internal perspective view of a 3-electrode surface discharge PDP 1. FIG. 2 is a cross-section of a unit display cell of the panel 1 of FIG. 1.

Referring to FIGS. 1 and 2, address electrode lines $A_{R1}$, $A_{G1}$, . . . , $A_{Gm}$, and $A_{Bm}$, front and rear dielectric layers 11 and 15, Y electrode lines $Y_1$, and $Y_n$, X electrode lines $X_1$, . . . , and $X_n$, phosphors 16, barrier ribs 17, and a MgO protective layer 12 are disposed between front and rear glass substrates 10 and 13 of the 3-electrode surface discharge PDP 1.

The address electrode lines $A_{R1}$, $A_{G1}$, . . . , $A_{Gm}$, and $A_{Bm}$ are arranged in a predetermined pattern over the rear glass substrate 13. The rear dielectric layer 15 is entirely coated over the address electrode lines $A_{R1}$, $A_{G1}$, . . . , $A_{Gm}$, and $A_{Bm}$. The barrier ribs 17 are formed on the front surface of the rear dielectric layer 15 to be parallel to the address electrode lines $A_{R1}$, $A_{G1}$, . . . , $A_{Gm}$, and $A_{Bm}$. The barrier ribs 17 define discharge areas of each discharge cell and prevent optical crosstalk between adjacent discharge cells. The phosphors 16 are coated between barrier ribs 17.

The X electrode lines $X_1$, . . . , and $X_n$ and the Y electrode lines $Y_1$, . . . , and $Y_n$ are patterned on a rear surface of the front glass substrate 10 so as to be orthogonal to the address electrode lines $A_{R1}$, $A_{G1}$, . . . , $A_{Gm}$, and $A_{Bm}$. The respective intersections define corresponding discharge cells. The X electrode lines $X_1$, . . . , and $X_n$ and the Y electrode lines $Y_1$, . . . , and $Y_n$ are each comprised of a transparent electrode line of a conductive material, such as, Indium Tin Oxide (ITO), and a metal electrode line for increasing conductivity. For example, as shown in FIG. 2, the X electrode line $X_n$ is comprised of a transparent electrode line $X_{na}$ and a metal electrode line $X_{nb}$, and the Y electrode line $Y_n$ is comprised of a transparent electrode line $Y_{na}$ and a metal electrode line $Y_{nb}$. The front dielectric layer 11 is entirely coated over the X electrode lines $X_1$, . . . , and $X_n$ and the Y electrode lines $Y_1$, . . . , and $Y_n$. The MgO protective layer 12 for protecting the panel 1 against strong electric fields is coated over the entire rear surface of the front dielectric layer 11. Discharge spaces 14 are sealed with a gas therein for forming a plasma.

As shown in FIG. 1, in the 3-electrode surface discharge PDP 1, not only the X electrode lines $X_1$, . . . , and $X_n$, the Y electrode lines $Y_1$, . . . , and $Y_n$, but also the dielectric layer 11 and the protective layer 12 formed on the X and Y electrode lines exist on the front glass substrate 10. During discharge, visible rays emitted from the phosphors 16 in the discharge spaces 14 pass through the front substrate 10. However, the 3-electrode surface discharge PDP 1 has a significant problem in that only about 60% of the visible rays are transmitted by the front substrate 10 because of various components formed on the front substrate 10.

Also, in the 3-electrode surface discharge PDP 1, electrodes provoking the discharge are formed over the discharge spaces 14, namely, on the inner surface of the front substrate 10 through which the visible rays pass, such that the discharge is generated on the inner surface thereof and spreads. Hence, the 3-electrode surface discharge PDP 1 has a low luminance efficiency.

Furthermore, when the 3-electrode surface discharge PDP 1 is used for a long period of time, charged particles of a discharge gas cause ion sputtering in the phosphor due to an electric field, thereby generating a permanent residual image.

Referring to FIGS. 3 through 6, a PDP 200 according to an embodiment of the present invention includes a front substrate 201, a rear substrate 202, barrier ribs 205, an upper sidewall 208, address electrodes 203, discharge electrodes 206 and 207, a phosphor layer 210, and magnets 250.

The front and rear substrates 201 and 202 face each other and are a predetermined distance apart from each other. The barrier ribs 205 are formed between the front and rear substrates 201 and 202 to partition a space between the front and rear substrates 201 and 202 into a plurality of discharge spaces 220. The upper sidewall 208 is formed between the barrier rib 205 and the front substrate 201 to define the discharge spaces 220 in cooperation with the barrier ribs 205. The address electrodes 203 extend on an upper surface of the rear substrate 202 in one direction. The discharge electrodes 206 and 207 are arranged within the upper sidewall 208 and are a predetermined interval apart from each other in a direction from the front substrate 201 to the rear substrate 202 so as to surround the discharge spaces 220 and to extend across the address electrodes 203. The phosphor layer 210 is formed on at least one surface of each of the discharge spaces 220. The magnets 250 are arranged within the upper sidewall 208 and are a predetermined distance apart from each other in a direction from the discharge electrodes 206 and 207 to the discharge spaces 220 so as to surround the discharge spaces 220. The PDP 200 can further include a dielectric layer 204 formed on the rear substrate 202 so as to cover the address electrodes 203.

As described above, the PDP 200 includes a pair of substrates facing each other at a predetermined distance apart from each other, for example, the front substrate 201 and the rear substrate 202. The barrier ribs 205 for defining the plurality of discharge spaces 220 are arranged in a predetermined pattern between the front and rear substrates 201 and 202. The barrier ribs 205 can be arranged in various patterns as long as the discharge spaces 220 can be formed. For example, the barrier ribs 205 can not only be open barrier ribs, such as, strips, but also closed barrier ribs, such as, ribs forming a waffle, a matrix, a delta, or the like. The barrier ribs 205 are closed barrier ribs, and the closed barrier ribs 205 are formed such that each of the discharge spaces 220 has a rectangular horizontal cross-section. However, the horizontal cross-section of each of the discharge spaces 220 can be polygonal (e.g., triangular, pentagonal, or the like), circular, oval, or the like.

Address electrodes 203 are arranged in a predetermined pattern to apply a voltage that selects a discharge space 220 where a discharge is to start, for example, in a striped pattern on the rear substrate 202 so as to correspond to each of the discharge spaces 220. The pattern of the address electrodes 203 is not limited to the striped pattern but can vary depending on the shape of the discharge spaces 220.

Although the address electrodes 203 can be arranged on the rear substrate 202, this does not limit the present invention, and the address electrodes 203 can be arranged on different suitable locations, such as the front substrate 201, the barrier ribs 205, and the like. The address electrodes 203 can be eliminated because the voltage that selects the discharge space 220 where a discharge is to start can be applied to a space between the discharge electrodes 206 and 207 by appropriately arranging the discharge electrodes 206 and 207, for example, by crossing them.

In the present embodiment, the dielectric layer 204 is formed on the rear substrate 202 so as to cover the address electrodes 220 as in a typical PDP. However, the dielectric layer 204 is optional. Although the barrier ribs 205 are disposed on the dielectric layer 204 in the present embodiment, the present invention is not limited to this embodiment. Instead, the barrier ribs 205 can be disposed on the rear substrate 202, and the address electrodes 203 and the phosphor layer 204 can be sequentially disposed on portions of the rear substrate 202 between the barrier ribs 205.

The upper sidewalls 208, which define the discharge spaces 220 in cooperation with the barrier ribs 205, are formed along the barrier ribs 205 between a pattern of the barrier ribs 205 and the front substrate 201. The discharge electrodes 206 and 207 and the magnets 250 are arranged within the upper sidewall 208 so as to surround the discharge spaces 220. The upper sidewall 208 is preferably formed of a dielectric. Preferably, a surface of the upper sidewall 208 that faces the discharge spaces 220 is covered with an MgO protective layer 209.

The discharge electrodes 206 and 207 are arranged within the upper sidewall 208, at a predetermined interval apart from each other in the direction from the front substrate 201 to the rear substrate 202 so as to surround the discharge spaces 220, and extend across the address electrodes 203. The discharge electrodes 206 are Y electrodes that select a discharge space to emit light from the discharge spaces by provoking an address discharge and X electrodes that provoke a sustain discharge in cooperation with the Y electrodes 206.

The X and Y electrodes 207 and 206 are arranged such that a discharge due to a difference between voltages applied to the X and Y electrodes 207 and 206 can start on surfaces of the upper sidewall 208 between the X and Y electrodes 207 and 206. Although the X and Y electrodes 207 and 206 are formed on the barrier ribs 205 in the present embodiment, the X and Y electrodes 207 and 206 can be arranged in various patterns and at various locations as long as a surface discharge can occur in the discharge spaces 220 defined by the X and Y electrodes 207 and 206. For example, the X and Y electrodes 207 and 206 can each have a shape of a rectangular ring and be arranged in parallel to each other within the upper sidewall 208 along the barrier ribs 205.

It is enough that the X and Y electrodes 207 and 206 are separated from each other at a distance such that a surface discharge can start and spread. However, it is preferable to decrease the distance between the X and Y electrodes 207 and 206 as much as possible, because the decrease enables a low voltage driving. Although each of the X and Y electrodes 207 and 206 has a ring shape in the present embodiment, they can have various shapes without being limited to the ring shape. Also, although the X and Y electrodes 207 and 206 can be arranged in various patterns, it is preferable that they are arranged such that a discharge can be easily initiated and spread even with a low voltage.

For example, to widen a discharge surface on which a discharge occurs as much as possible, the X and Y electrodes 207 and 206 can be arranged in such a way that ring-shaped Y electrodes 206 are disposed over and under a ring-shaped X electrode 207, respectively, or that ring-shaped X electrodes 207 are disposed over and under a ring-shaped Y electrode 206, respectively. Due to this arrangement, an effect that a discharge surface is enlarged in a height direction of the discharge spaces 220 can be obtained. In this case, to lower an address voltage to be applied between an address electrode 203 and a Y electrode 206, the Y electrode 206 is preferably disposed close to the address electrode 203, that is, close to the rear substrate 202.

The X and Y electrodes 207 and 206 can be arranged so that facing parts of the X and Y electrodes 207 and 206 are arranged on a lateral surface of the discharge space 220 to be perpendicular to the front substrate 201.

Due to this arrangement of the discharge electrodes 206 and 207, an effect in which the discharge surface is extended in a circumferential direction of the discharge spaces 220 can be obtained. The discharge electrodes 206 and 207 can have other shapes and can be arranged in other patterns. The X and Y electrodes 207 and 206 can be formed using various methods, for example, a printing method, a sandblasting method, a deposition method, and the like. Preferably, the X and Y electrodes 207 and 206 are all arranged over the barrier ribs 205.

Figure 3:
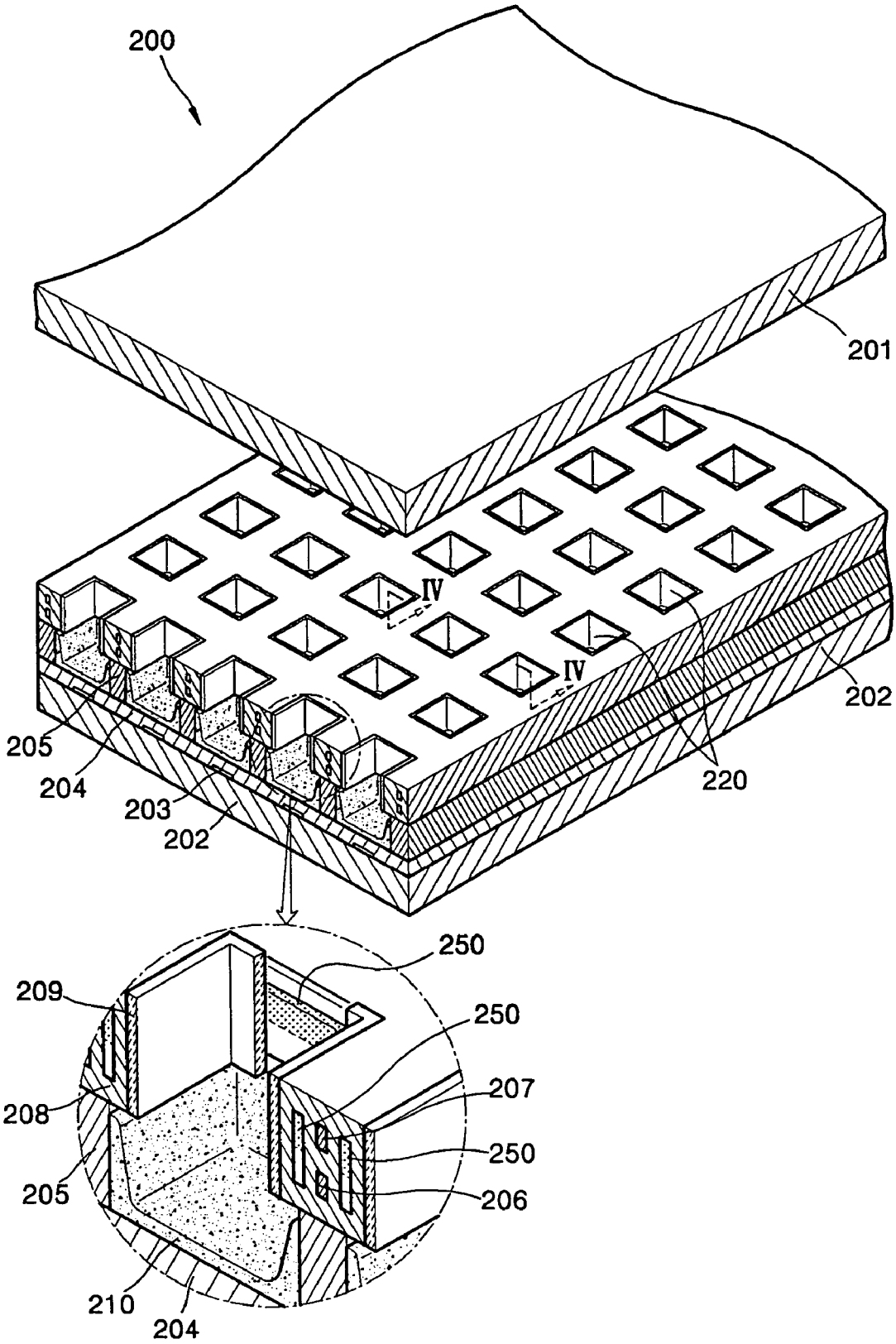
FIG. 3 is an exploded perspective view of a part of a PDP according to an embodiment of the present invention.
Figure 4:
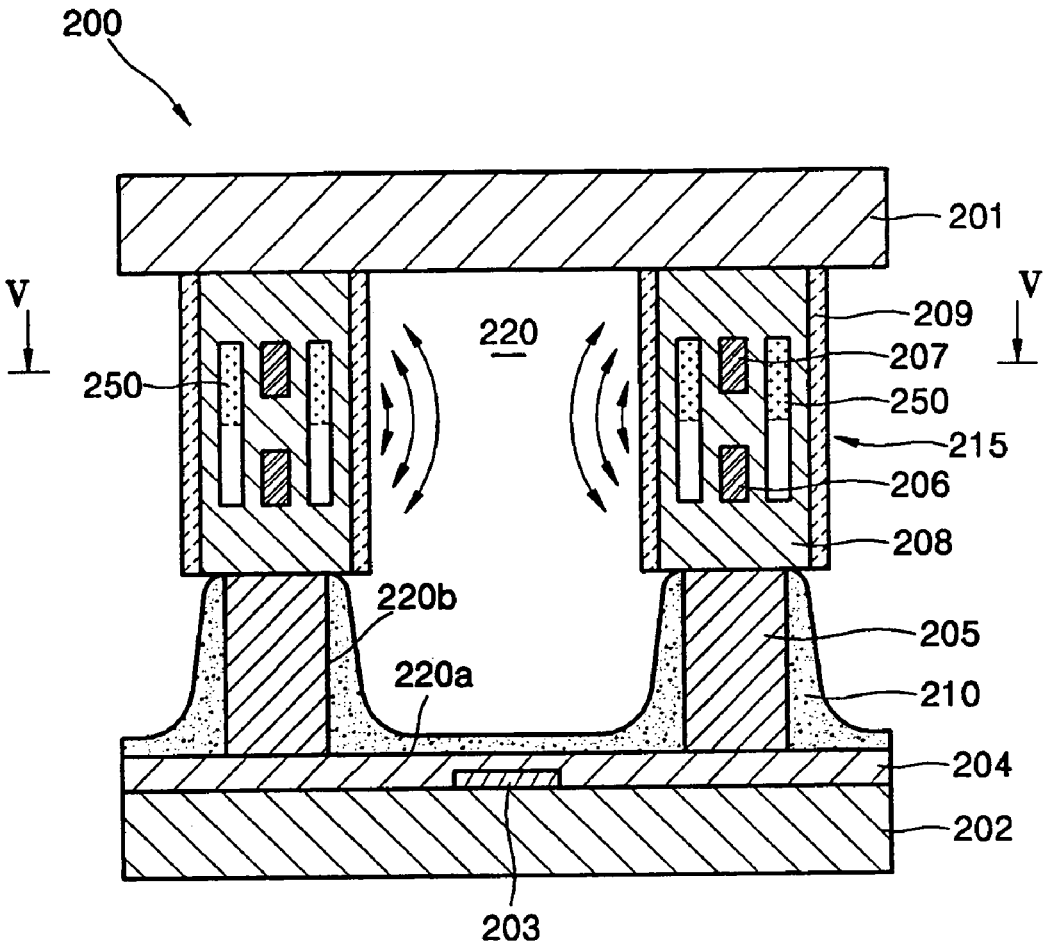
FIG. 4 is a cross-section of a single discharge space of the PDP of FIG. 3 taken along line IV—IV.
Figure 5:
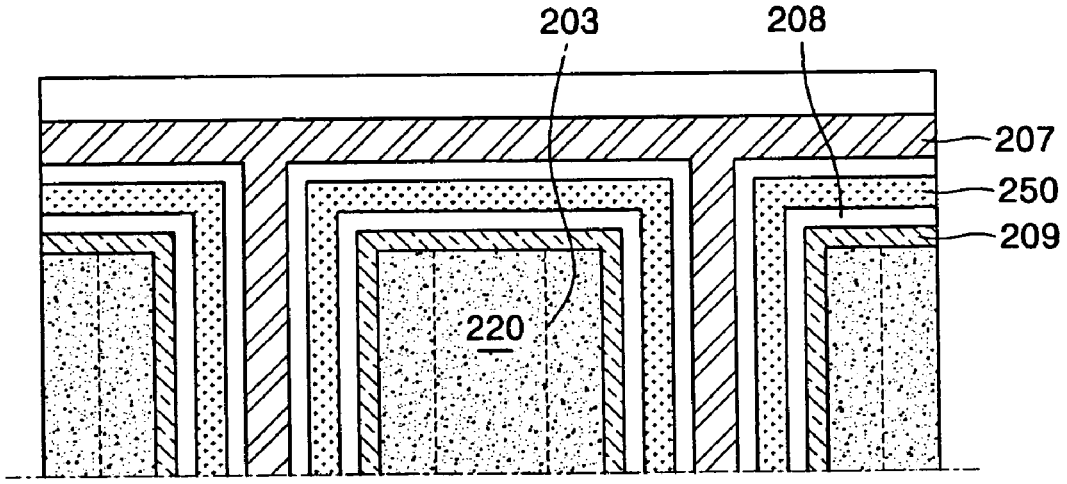
FIG. 5 is a cross-section taken along line V—V of FIG. 4.
Figure 6:
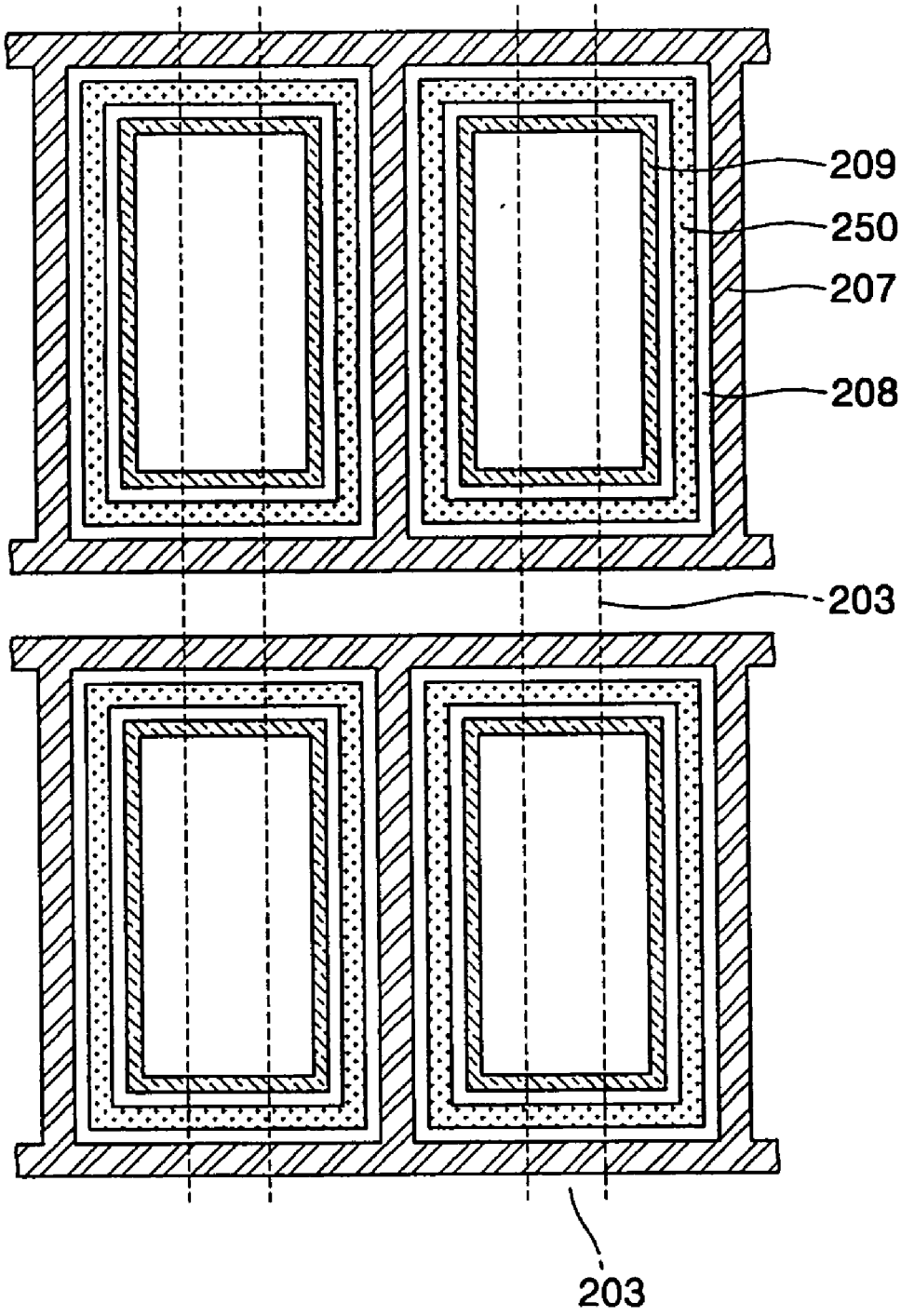
FIG. 6 is a plan view of a configuration of the discharge electrodes of FIG. 3.

As shown in FIG. 3, the magnets 250 are arranged in an upper sidewall 208 on at least one side of the discharge space 220 at a predetermined distance apart from each other in a direction from the discharge electrodes 206 and 207 to the discharge space 220. The magnets 250 can be arranged so as to surround the discharge space 220. Preferably, the magnets 250 can be disposed along four lateral surfaces of the discharge space 220 so as to surround the discharge space 220 as shown in FIG. 6.

Preferably, the magnets 250 are permanent magnets.

The magnets 250 are preferably disposed perpendicular to a direction from the front substrate 201 to the rear substrate 202. In other words, each magnet 250 is disposed in such a way that one of N and S poles of the magnet 250 faces the front substrate 201 and the other faces the rear substrate 202. For example, the magnet 250 can be disposed so that the N pole faces the front substrate 201 and the S pole faces the rear substrate 202. Alternatively, the magnet 250 can be disposed so that the S pole faces the front substrate 201 and the N pole faces the rear substrate 202.

A plasma is converged by an electric field formed within a discharge space 220 by alternately applying a voltage to the X and Y electrodes 207 and 206. Charged particles of the plasma moving at a predetermined angle with respect to a direction of a magnetic field make a spiral motion along force lines of the magnetic field. Hence, the charged particles of the plasma move spirally in the force lines of the magnetic field formed by the magnets 250. The probability that the charged particles collide with a discharge gas increases, and the amount of excited particles of the discharge gas produced increases. Accordingly, the amount of plasma generated increases, a plasma density increases, the amount of vacuum ultraviolet light increases, the luminance increases, and as much luminance efficiency as the increase of the luminance increases. In an experiment according to the present invention where magnets exist, the plasma density increased about 30% over the plasma density when no magnets exist, and thus, the luminance increased about 15 to 20% over the plasma density when no magnets exist.

The phosphor layer 210, which emit visible rays by being excited by ultraviolet rays generated by a discharge gas, is formed in the discharge space 220 defined by the barrier ribs 205, the upper sidewall 208, the dielectric layer 204, and the front substrate 201. The phosphor layer 210 can be formed at any location on the discharge space 220. However, considering transmittance of the visible rays and the like, the phosphor layer 210 is preferably formed to cover a bottom portion of the discharge spaces 220 that is close to the rear substrate 202. Particularly, the phosphor layer 210 is formed to cover a portion of the dielectric layer 204 corresponding to a bottom surface 220*a* of the discharge space 220 and the barrier ribs 205 corresponding to a lateral surface 220*b* of the discharge space 220.

A discharge gas, such as, Ne, Xe, a mixture of Ne and Xe, or the like, is sealed in each of the discharge spaces 220. In the plasma display panel 200 according to the present embodiment, the amount of plasma formed increases due to an increase in the discharge surface and an extension of a discharge area, so that the panel 200 can be driven by a low voltage. Hence, the plasma display panel 200 can be driven by a low voltage even when a high-concentration Xe gas is used as a discharge gas, thereby significantly increasing the luminance efficiency. This feature of the present embodiment solves a problem in that driving a conventional PDP with a low voltage is difficult when the high-concentration Xe gas is used as the discharge gas.

An upper opening of each of the discharge spaces 220 is enclosed by the front substrate 201. The front substrate 201 does not include Indium Tin Oxide (ITO) discharge electrodes, bus electrodes, and a dielectric layer formed on a front substrate to cover the discharge electrodes and the bus electrodes. Accordingly, in the plasma display panel 200, an opening ratio of the front substrate 201 is significantly enhanced, and the transmittance of the visible rays is increased up to 90%. Thus, the panel 200 can be driven by a low voltage, consequently maximizing luminance efficiency. The front substrate 201 can be formed of any material as long as the material is transparent. For example, the front substrate 201 can be formed of glass.

A discharge occurring during a sustain discharge period when the PDP 200 of in FIGS. 3 through 6 is driven using a typical method is as follows.

First, when a predetermined address voltage received from an external power source is applied between the address electrodes 203 and the Y electrodes 206, a discharge space 220 is selected to emit light, and wall charges are accumulated on a Y electrode 206 of the selected discharge space 220.

Then, when a positive voltage is applied to an X electrode 207 of the selected discharge space 220 and a voltage lower than the positive voltage is applied to the Y electrodes 206 of the selected discharge space 220, wall charges are moved due to a difference between voltages applied to the X and Y electrodes 207 and 206. The moving wall charges provoke a discharge by colliding with discharge gas atoms existing within the selected discharge space 220, thus generating a plasma. This discharge is highly likely to occur in a space between the X and Y electrodes 207 and 206 where a strong electric field is formed.

In the present embodiment, the space between the X and Y electrodes 207 and 206 exists on four lateral surfaces of the discharge space 220, so that the possibility that a discharge occurs is drastically increased compared with a conventional arrangement in which a space between discharge electrodes exist only on an upper surface of a discharge space. When a sufficiently large difference between voltages applied to X and Y electrodes is kept, electric fields formed between the X and Y electrodes are concentrated from the lateral surfaces of the discharge space 200 to produce a strong electric field. Thus, the discharge is spread to the entire discharge space 220. The discharge in the present embodiment has a ring shape and occurs on the four lateral surfaces of the discharge space 220. The ring-shaped discharge is spread to the center of the discharge space 220. On the other hand, a discharge in a conventional arrangement occurs from only an upper surface of a discharge space and is spread to the center of the discharge space. Therefore, the discharge in the present embodiment is more widely spread than the discharge in the conventional arrangement.

The plasma produced due to the discharge in the present embodiment is also formed in the shape of a ring around the four lateral surfaces of the discharge space 220 and spreads to the center of the discharge space 220, so that the plasma is greatly enlarged, resulting in a significant increase of the amount of visible light. Due to the concentration of the plasma to the center of the discharge space 220, space charges can be utilized to thus enable the PDP in the present embodiment to be driven by a low voltage and to increase luminance efficiency.

Since the plasma is concentrated at the center of the discharge space 220 and electric fields generated by the discharge electrodes 206 and 207 exist on four lateral surfaces of the plasma, charges are collected on the center of the discharge space 220 to prevent ion sputtering in the phosphor layer 210.

When such discharge is formed and then the difference between the voltages applied to the X and Y electrodes 207 and 206 is lower than a discharge voltage, no more discharge occurs, and space charges and wall charges are formed in the discharge space 220. At this time, when polarities of the voltages applied to the X and Y electrodes 207 and 206 are reversed, a new discharge occurs with the help of the wall charges. Thereafter, the discharge spreads to the entire discharge space 220 and then disappears.

When the polarities of the voltages applied to the X and Y electrodes 207 and 206 are again reversed, the initial discharge process resumes. By repeating this process, a stable discharge occurs. However, the discharge in the present embodiment does not limit the scope of the present invention, but various types of discharge can be thought of by those of ordinary skill in the art.

Figure 7:
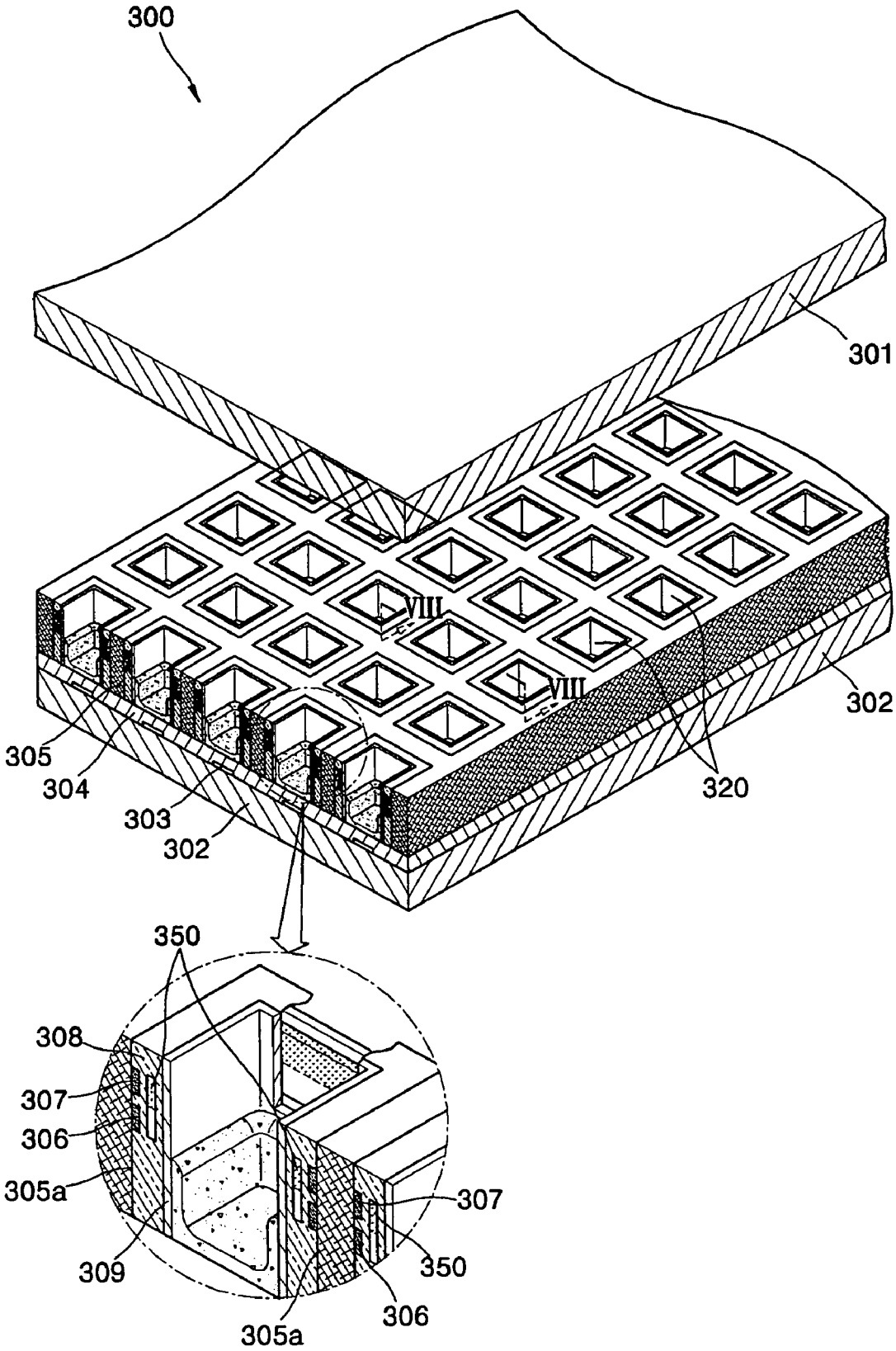
FIG. 7 is an exploded perspective view of a part of a PDP according to another embodiment of the present invention.
Figure 8:
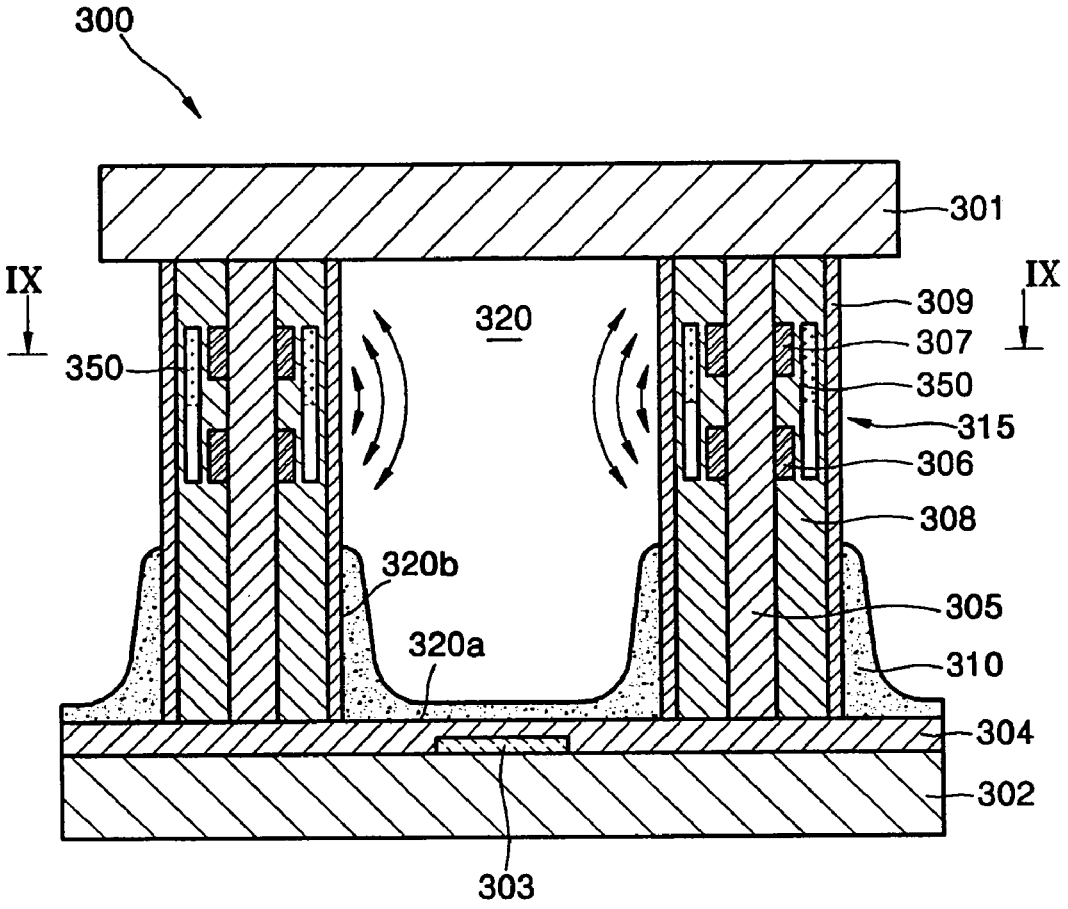
FIG. 8 is a cross-section of a single discharge space of the PDP of FIG. 7 taken along line VIII—VIII.
Figure 9:
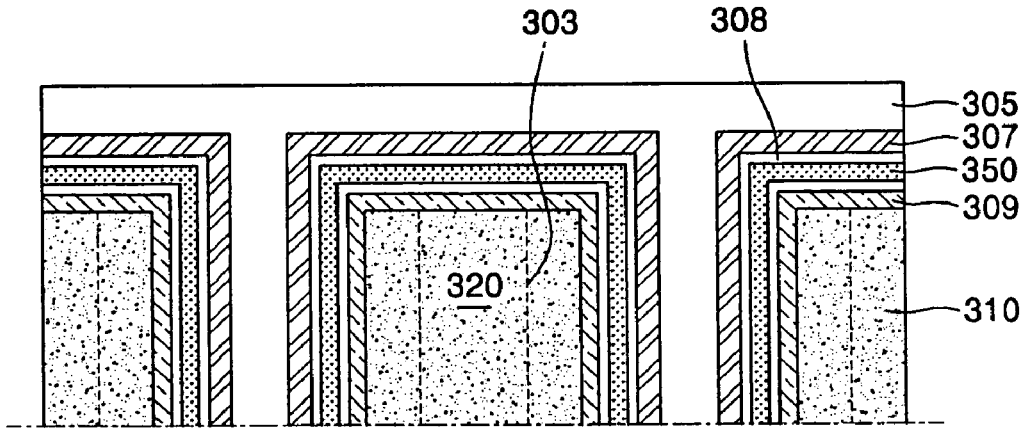
FIG. 9 is a cross-section taken along line IX—IX of FIG. 8.
Figure 10:
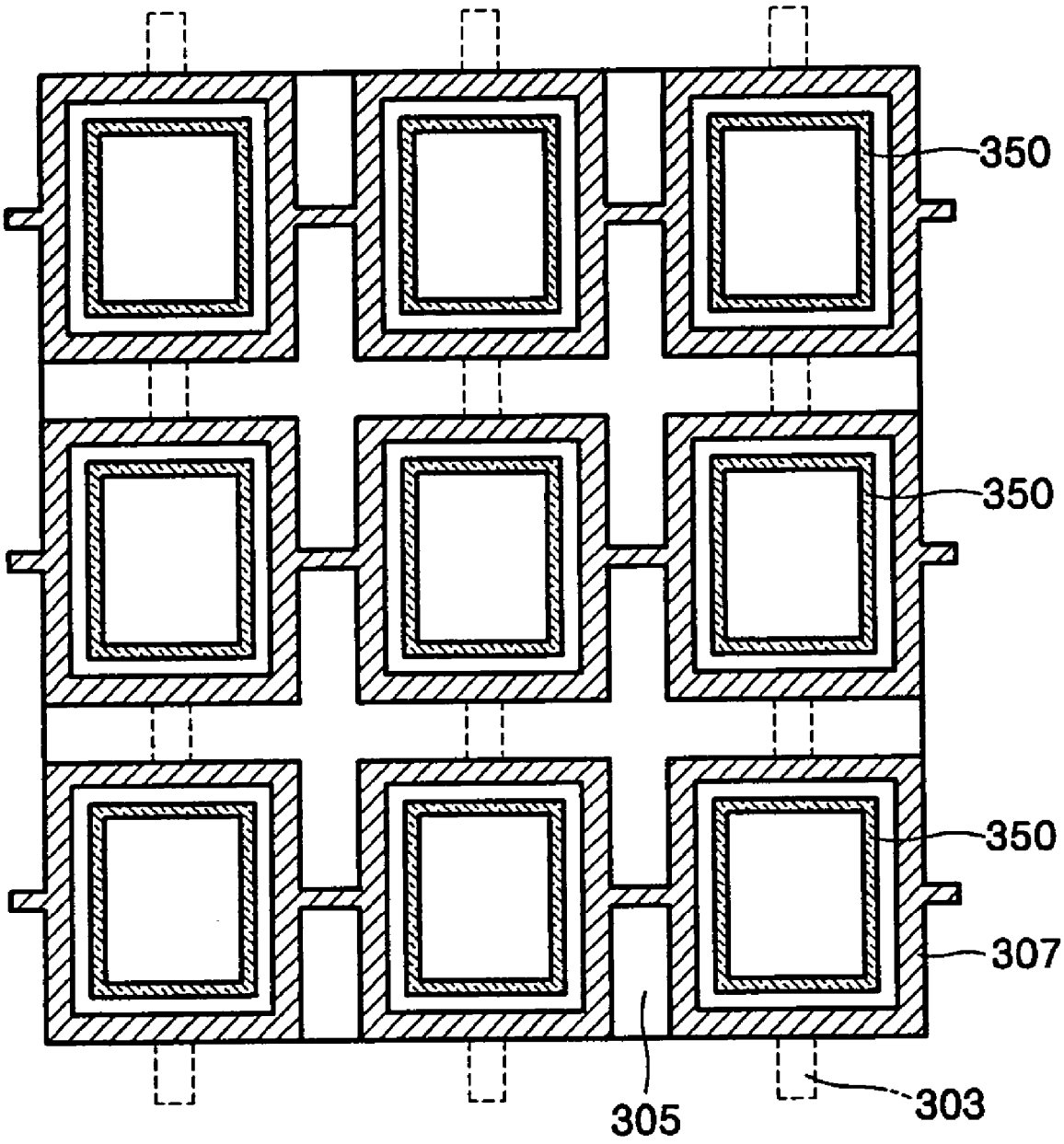
FIG. 10 is a plan view of a configuration of the discharge electrodes of FIG. 7.

FIG. 7 is an exploded perspective view of a part of a PDP 300 according to another embodiment of the present invention. FIG. 8 is a cross-section of a single discharge space of the PDP 300 of FIG. 7 taken along line VIII—VIII. FIG. 9 is a cross-section taken along line IX—IX of FIG. 8. FIG. 10 is a plan view of a configuration of the discharge electrodes of FIG. 7.

Referring to FIGS. 7 through 10, the PDP 300 is similar to the PDP 200 in that magnets surround discharge spaces 320 to form a magnetic field in the discharge spaces 320, thereby increasing the plasma density and the luminance efficiency. Thus, the same items as those in the previous embodiment will not be described in greater detail. Like reference numerals denote the same elements.

The PDP 300 includes front and rear substrates 301 and 302, barrier ribs 305, address electrodes 303, discharge electrodes (Y and X electrodes) 306 and 307, a first dielectric layer 310, a phosphor layer 310, and magnets 350.

The front and rear substrates 301 and 302 face each other at a predetermined distance apart. The barrier ribs 305 define a plurality of discharge spaces 320 in a space between the front and rear substrates 301 and 302. The address electrodes 303 extend in strips in one direction on an upper surface of the rear substrate 302. The discharge electrodes 306 and 307 are arranged in parallel on the barrier ribs 305 at a predetermined distance apart in a substrate direction from the front substrate 301 to the rear substrate 302 so as to surround the discharge spaces 320. The discharge electrodes 306 and 307 extend across the address electrodes 303. The first dielectric layer 308 covers the discharge electrodes 306 and 307. The phosphor layer 310 is formed on at least one surface of each of the discharge spaces 320. The magnets 350 are arranged in the first dielectric layer 308 at a predetermined distance apart in a direction from the discharge electrodes 306 and 307 to each of the discharge spaces 320 so as to surround the discharge spaces 320. Preferably, the PDP 300 further includes a second dielectric layer 304 formed on the rear substrate 302 to cover the address electrodes 303.

The barrier ribs 305 define discharge spaces and also serve as a base in which the discharge electrodes 306 and 307 are installed. Accordingly, the barrier ribs 305 can be formed in any shape as long as the discharge electrodes 306 and 307 can be disposed so that a discharge is initiated and spreads. For example, a lateral side of each of the barrier ribs 305 can extend either perpendicular to the front substrate 301 or at a slant with respect to a direction perpendicular to the front substrate 301. Alternatively, the lateral side can be curved in such a way that one end extends at a slant in one direction and the other end extends at a slant in the opposite direction.

Depending on various shapes of the barrier ribs 305, the discharge electrodes 306 and 307 can be arranged in various patterns on the lateral side of each of the barrier ribs 305. Various types of discharges can start and spread depending on the various shapes of a discharge surface formed by the discharge electrodes 306 and 307.

Electrodes that provoke a discharge in each of the discharge spaces 320, for example, the X and Y electrodes 307 and 306, are formed on the barrier ribs 305. The X and Y electrodes 307 and 306 are arranged such that discharge due to a difference between voltages applied to the X and Y electrodes 307 and 306 can start on surfaces of the barrier ribs 305 between the X and Y electrodes 307 and 306. Although the X and Y electrodes 307 and 306 are formed on the barrier ribs 305 in the present embodiment, the X and Y electrodes 307 and 306 can be arranged in various patterns and on various locations as long as a surface discharge can occur in the discharge spaces 320 defined by the X and Y electrodes 307 and 306. For example, the X and Y electrodes 307 and 306 can each have a ring shape and be arranged parallel to each other around the lateral sides of the barrier ribs 305.

In the present invention, the plasma density is increased due to an influence of a magnetic field formed by magnets, the density of excited particles of a discharge gas is accordingly increased, the amount of ultraviolet light emitted is increased, and thus the luminance efficiency is improved.

Also, visible rays emitted from a discharge space pass through a front substrate. Since no elements are formed on the front substrate, through which the visible rays pass, the front substrate has an opening ration and a visible ray transmittance that are significantly enhanced.

Since a surface discharge can occur on all lateral surfaces of a discharge space, the surface discharge is about four times wider than the surface discharge in a conventional arrangement.

Since a discharge occurs on lateral surfaces of a discharge space and is spread to a center of the discharge space, a discharge area is significantly wider than the discharge area in a conventional arrangement. Hence, the entire discharge space can be efficiently used. Also, a plasma formed due to the discharge is significantly enlarged, so that the amount of plasma is greatly increased and consequently, an increased amount of ultraviolet rays are emitted.

Even when a Xe partial pressure within the discharge gas is high, a stable address discharge and highly efficient discharge display are possible.

Since an electric field formed by a voltage applied to the discharge electrodes formed on lateral surfaces of a discharge space concentrates plasma at a center of the discharge space, collision of ions produced by discharge with phosphors is prevented even when a long-term discharge occurs. Thus, a permanent residual image is prevented from being generated due to damage to the phosphors from ion sputtering.

Due to the aforementioned advantages, the PDP according to the present invention can be driven even by a low voltage, thus significantly enhancing the luminance efficiency.

While the present invention has been particularly shown and described with reference to exemplary embodiments thereof, it will be understood by those of ordinary skill in the art that various modifications in form and details can be made therein without departing from the spirit and scope of the present invention as defined by the following claims.

What is claimed is:

1. A plasma display panel comprising:

a front substrate and a rear substrate arranged at a predetermined distance apart to face each other;

barrier ribs arranged between the front and rear substrates to partition a space formed between the front and rear substrates into a plurality of discharge spaces;

upper sidewalls arranged between the barrier ribs and the front substrate to define the discharge spaces in cooperation with the barrier ribs;

address electrodes extending in one direction over the rear substrate;

discharge electrodes arranged within the upper sidewalls, the discharge electrodes arranged in parallel at a predetermined distance apart in a direction from the front substrate to the rear substrate so as to surround the discharge spaces and so as to extend across the address electrodes;

a phosphor layer arranged on at least one surface of each of the discharge spaces; and magnets arranged in the upper sidewalls at a predetermined distance apart in a direction from the discharge electrodes to the discharge spaces.

2. The plasma display panel of claim 1, wherein the magnets comprise permanent magnets.

3. The plasma display panel of claim 1, wherein the magnets are arranged to surround the discharge spaces.

4. The plasma display panel of claim 1, wherein the magnets are arranged perpendicular to a direction from the front substrate to the rear substrate.

5. The plasma display panel of claim 1, wherein each magnet is arranged with one of its N and S poles facing the front substrate and the other of its N and S poles facing the rear substrate.

6. The plasma display panel of claim 1, wherein the discharge electrodes comprise:

Y electrodes adapted to select a discharge space to emit light from the discharge spaces by provoking an address discharge between the Y electrodes and the address electrodes; and X electrodes provoking a sustain discharge between the Y electrodes and the X electrodes.

7. The plasma display panel of claim 1, wherein the discharge electrodes are arranged perpendicular to the front substrate.

8. The plasma display panel of claim 1, wherein the upper sidewalls comprise a dielectric.

9. The plasma display panel of claim 1, wherein the upper sidewalls are covered with an MgO layer.

10. The plasma display panel of claim 1, further comprising a dielectric layer adapted to cover the address electrodes.

11. A plasma display panel comprising:

a front substrate and a rear substrate arranged at a predetermined distance apart to face each other;

barrier ribs arranged between the front and rear substrates to partition a space formed between the front and rear substrates into a plurality of discharge spaces;

upper sidewalls arranged between the barrier ribs and the front substrate to define the discharge spaces in cooperation with the barrier ribs;

address electrodes extending in one direction over the rear substrate;

discharge electrodes arranged within the upper sidewalls, the discharge electrodes arranged in parallel at a predetermined distance apart in a direction from the front substrate to the rear substrate so as to surround the discharge spaces and so as to extend across the address electrodes;

a first dielectric layer adapted to cover the discharge electrodes;

a phosphor layer arranged on at least one surface of each of the discharge spaces; and magnets arranged in the upper sidewalls at a predetermined distance apart in a direction from the discharge electrodes to the discharge spaces.

12. The plasma display panel of claim 11, wherein the magnets comprise permanent magnets.

13. The plasma display panel of claim 11, wherein the magnets are arranged to surround the discharge spaces.

14. The plasma display panel of claim 11, wherein the magnets are arranged perpendicular to a direction from the front substrate to the rear substrate.

15. The plasma display panel of claim 11, wherein each magnet is arranged with one of its N and S poles facing the front substrate and the other of its N and S poles facing the rear substrate.

16. The plasma display panel of claim 11, wherein the discharge electrodes comprise:

Y electrodes adapted to select a discharge space to emit light from the discharge spaces by provoking an address discharge between the Y electrodes and the address electrodes; and X electrodes provoking a sustain discharge between the Y electrodes and the X electrodes.

17. The plasma display panel of claim 11, wherein the discharge electrodes are arranged perpendicular to the front substrate.

18. The plasma display panel of claim 11, wherein the first dielectric layer is covered with an MgO layer.

19. The plasma display panel of claim 11, further comprising a second dielectric layer adapted to cover the address electrodes.

* * * * *